United States Patent [19]

Gindel

[11] 4,238,818

[45] Dec. 9, 1980

[54] NONROTATABLE TELESCOPING SUPPORTING STRUCTURE

[76] Inventor: Alvin Gindel, 36 Wenwood Dr., Brookville, Long Island, N.Y. 11101

[21] Appl. No.: 942,917

[22] Filed: Sep. 18, 1978

[51] Int. Cl.[3] ..... F21S 3/12

[52] U.S. Cl. ..... 362/413; 362/285; 362/289; 362/431

[58] Field of Search ..... 362/285, 289, 403, 413, 362/429–431

[56] References Cited

U.S. PATENT DOCUMENTS

| | | | |
|---|---|---|---|
| 998,323 | 7/1911 | Camp | 362/413 X |
| 2,301,661 | 10/1942 | Weidenhoeft | 362/413 X |
| 2,409,075 | 10/1946 | Starck | 362/413 X |
| 2,624,537 | 1/1953 | Rouy | 362/285 X |
| 2,902,592 | 9/1959 | Cole et al. | 362/413 X |
| 3,012,801 | 12/1961 | Cole | 362/413 X |
| 3,586,852 | 7/1971 | Bradley | 362/413 X |

FOREIGN PATENT DOCUMENTS

| | | | |
|---|---|---|---|
| 1008495 | 5/1967 | Fed. Rep. of Germany | 362/413 |

*Primary Examiner*—Peter A. Nelson

*Attorney, Agent, or Firm*—Lackenbach, Lilling & Siegel

[57] ABSTRACT

A nonrotatable telescoping supporting structure particularly suited for a pole lamp supporting means including an outer elongated tubular member of substantially cylindrical shape, an inner elongated member having at least one portion of reduced radial size with respect to the longitudinal central axis of the inner member. The reduced portion extends substantially along the entire length of the inner member and there is additionally provided a protuberance located along the inner surface of the outer member, which protuberance extends inwardly. Portions of the inner member in juxtaposition to the reduced radial portion move into engagement with the protuberance to prevent relative rotation between the members.

4 Claims, 7 Drawing Figures

NONROTATABLE TELESCOPING SUPPORTING STRUCTURE

BACKGROUND OF THE INVENTION

1. FIELD OF THE INVENTION

The present invention relates broadly to a novel supporting structure which is readily adaptable for use as a pole lamp supporting means, and more particularly to a nonrotatable telescoping supporting structure for use in constructing electric lighting lamps wherein the electric wires are disposed within the telescoping members and, relative rotation between the members is prevented thereby significantly reducing the changes of damaging the electrical wires running therethrough. The present invention therefore provides for an improved supporting means which fully complies with generally accepted safety codes.

2. DESCRIPTION OF THE PRIOR ART

Various attempts have been made in the past to produce a nonrotatable telescoping supporting means for use in lamps which, usually included the inner member having an elongated stationary guide means. The use of elaborate and complicated mechanisms to prevent rotation of telescoping members have been utilized in the past, but such means include the stationary guiding structure located on additional components which do not form part of the telescoping members themselves.

There exists prior art U.S. patents which disclose nonrotatable telescoping supporting structures. However, none of the prior art patents teaches or suggests in any manner, either singly or in combination, the structure disclosed herein.

The prior art U.S. patents Nos. known to Applicant are as follows:

Cole: 3,012,801
Cole et al: 2,902,592
Wolar: 2,748,261
Jarrett et al: 2,553,094
Starck: 2,409,075
Doane: 2,994,886

Jarret et al discloses a screw 51 having a rounded terminal positioned in the upright support 25 and the terminal projects entirely through and into the slot 52 in the adjustable post 29 to provide upward and downward limits of movement of the post 29.

Doane shows the use of a cross bar located within the telescoping lamp parts, which bar extends completely through the inner tube to prevent rotation and limit travel vertically.

Wolar discloses lugs which are apt to cooperate with T-shaped slots formed in the inner member to adjust the height of a lighting fixture supporting means. The elaborate configuration of the slots is adapted to facilitate small increments of vertical adjustments.

Starck and Cole et al show the use of a longitudinal groove formed in the inner member which is adapted to engage elongated ridges therein.

Cole shows the use of internal buttons 23 and a longitudinal indentation 34 to limit rotation to a predetermined angle.

SUMMARY OF THE INVENTION

The present invention overcomes the disadvantages of the prior art telescoping supporting structures by providing a nonrotatable telescoping structure particularly suited for use in pole lamp supporting means including an outer elongated tubular member of substantially cylindrical shape, an inner elongated member having at least one portion of reduced radial size with respect to the longitudinal central axis of the inner member, the portion extending substantially the entire length of the inner member. The protuberance which is located on the inner surface of the outer member extends inwardly therefrom such that the inner member, when disposed within the outer member with the radially reduced portion opposing said protuberance, allows for relative longitudinal movement of said members as desired; but relative rotation therebetween is prevented by engagement of said protuberance with portions of said inner member in juxtaposition with the reduced portion.

It is an object of the present invention to overcome the disadvantages of prior art telescoping supporting means and provide a nonrotatable telescoping support which may be readily adaptable to various uses.

It is a further object of the present invention to provide an inner member having a shape and configuration which is easily manufactured or readily available in the trade.

It is still yet another object of the present invention to provide a simple means located on the inner surface of the outer member which is apt to engage portions of the inner member to prevent relative rotation between the telescoping members, and to locate such means such that it does not form a part of the structure for holding said members stationary with respect to one another.

It is still yet a further object of the present invention to provide a nonrotatable telescoping supporting structure which may be manufactured from readily available materials and which is not affected by changes in temperatures, moisture, or humidity.

Still further objects and features of the present invention reside in the provision of a structure which is simple in construction, and inexpensive to manufacture, thereby permitting wide use and distribution.

These together with the various ancilliary objects and features of the invention will become apparent as the following description proceeds, are obtained by the telescoping supporting structure, preferred embodiments of which are shown in the accompanying drawing, by way of example only, wherein:

DETAILED DESCRIPTION OF THE INVENTION

Figure 1:
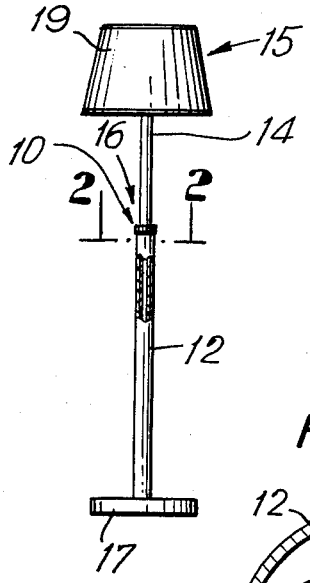
FIG. 1 is a side elevational view of a lamp incorporating a nonrotatable telescoping supporting structure made in accordance with the present invention, shown with portions broken away to reveal internal structure.

With continuing reference to the accompanying drawing wherein like reference numerals designate similar parts throughout the various views, reference numeral 10 is used generally to designate the nonrotatable telescoping supporting structure of the present invention which includes an outer elongated tubular member 12 and an inner elongated member 14 which is of a noncircular cross-sectional shape.

The supporting structure within the scope of the present invention is especially adapted and particularly useful in connection with electrical lamp supports and therefore it is preferable that members 12 and 14 be manufactured of metal having a painted, glazed or plated outer surface which is pleasing to the eye, however, it must be understood, that it is within the scope of the present invention that such members may be manufactured of any suitable substantially rigid material including wood and plastic.

With reference to FIG. 1, there is shown a floor supported room lamp 15 having a base 17 and a shade 19, which lamp 15 is provided with suitable means (not shown) for electrically receiving conventional incandescent or florescent light bulbs or the like. When it is desired to change the elevation of shade 19, the telescoping supporting structure 10 comes into play and includes a securing structure 16 which allows for telescoping longitudinal displacement between members 12 and 14 and is adapted to secure the members in any desired position.

Figure 7:
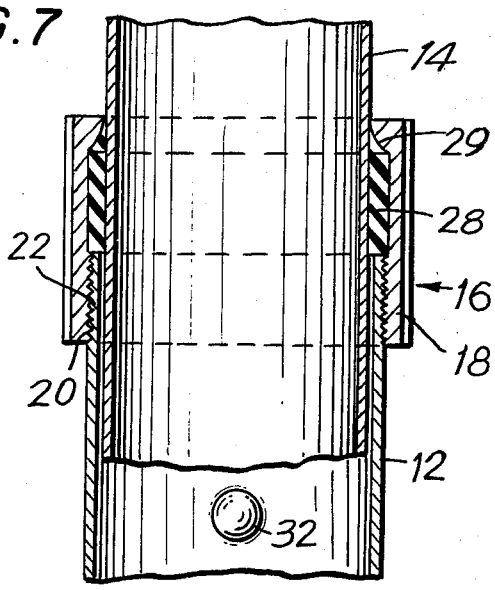

There are various securing structures 16 which may be incorporated in the present invention which allow longitudinal movement between members 12 and 14 but are apt to retard or prevent relative longitudinal movement when desired. A preferred embodiment, as depicted in FIG. 7, is a securing structure including a capping means 18 which is substantially cylindrical and adapted to engage the upper and outer portion of member 14 which includes threads 20. There are complimentary threads 22 on the inside surface of cap 18, and the cap includes an annular lip 24 which defines an opening 26 at the top of cap 18. Opening 26 is of a diameter slightly greater than that of the largest external diameter of inner member 14.

The capping means further includes a split ring 28 which is tapered at its upper end at 29 and is apt to engage a complimentary sloping portion 30 formed in the interior of cap 18.

The split ring 28 is of a flexible material, and of the same general cross-sectional size when unstressed as outer member 14, and is disposed on the top thereof. When the cap means 18 is disposed thereover and is forced downwardly by manual rotation due to the threaded portions 20 and 22, the tapered portions 29 and 30 are forced to urge the ring 28 to compress inwardly. Such action of the ring causes it to forcefully engage the inner member 14 such that the inner member may be retained in a fixed position with respect to member 12. The split ring is retained in superposed relationship at the top of member 14 and is thereby prevented from being displaced downwardly. The outer surface of the capping means 18 may be knurled to facilitate manual rotation thereof.

Outer member 12 is of circular internal cross-sectional shape, and is preferably a hollow tube. However, it is within the scope of the present invention that the exterior shape of outer member 12 may be of any desired shape such as a common geometric form (square, triangular and the like) or may be free-form, or have any desired surface ornamentation.

There is provided on the interior surface of member 12 a protuberance 32 which is located below the securing means 16, but is preferably located at substantially the upper section of member 12, such as by the application of a small portion of solder or welding material as in the case when member 12 is of a metal. It is also possible to produce the protuberance by forming a dimple or punched-in portion in the outer member 12 such that there is an inward protrusion of the substantially cylindrical tube, which extends beyond the general overall diameter of the member.

Figure 6:
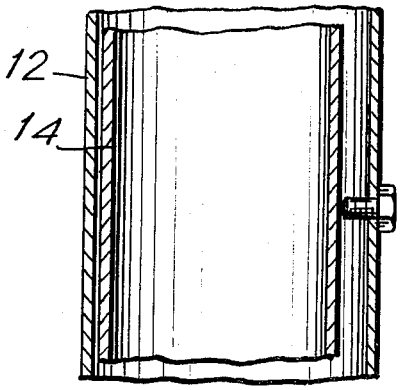
FIG. 6 is a partial vertical cross-sectional view similar to that shown in FIG. 5, depicting an alternative embodiment of the protuberance.

It is further within the scope of the present invention to produce the protuberance by inserting a screw or bolt completely through the outer member, such as depicted in FIG. 6, as well as producing the protuberance in any suitable manner such that there is created a rigid portion firmly affixed to the outer member 12 which extends inwardly therefrom.

Figure 4:
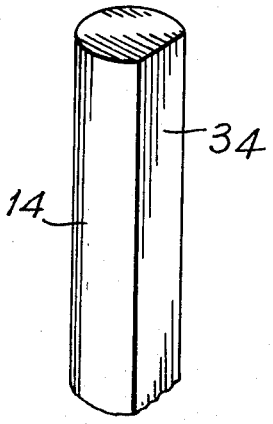
FIG. 4 is a perspective view of an inner member similar to that shown in FIG. 2.
Figure 5:
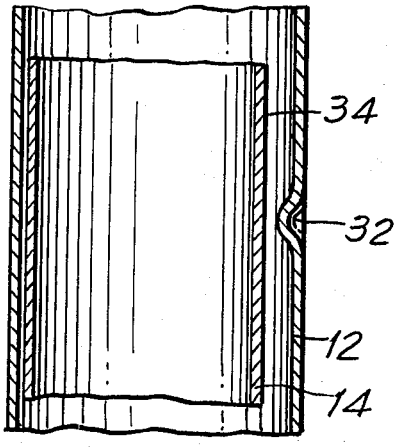
FIG. 5 is a partial vertical cross-sectional view taken along the plane of line 5—5 in FIG. 2.

Inner member 14 is of a slightly smaller overall external dimension that the inner diameter of the outer member such that there may be telescoping longitudinal displacement therebetween. As the present invention is particularly suited as a base for electrical room lamps, it is preferable that inner portion 14 be a hollow tube, or the like, so that there is ample room to run electrical wires therethrough. However, as depicted in FIG. 4, it is within the scope of the present invention that inner member 14 be a solid rod or the like. There is formed in member 14, extending substantially the entire length thereof, a portion of reduced radial size 34, which when members 12 and 14 are placed in telescoping arrangement, is disposed opposingly to protuberance 32. The reduction of the radial size of member 14 at 34 allows member 14 to slide within member 12 without the protuberance 32 engaging member 14. It is intended that the size of the protuberance be created with regard to the size of the reduced radial portion 34 such that they are complimentary.

Figure 3:
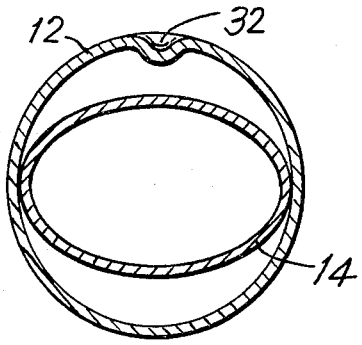
FIG. 3 is a horizontal cross-sectional view similar to that in FIG. 2, but depicting an alternative embodiment of the inner member.

As shown in FIG. 3, the inner member 14 may be of a general oval shape such that the major transverse axis of elongated member 14 corresponds in length to the inner diameter of the outer member 14, and the minor transverse axis be dimensioned such that it is shorter than the major axis a distance of at lease twice the transverse extension of the protuberance from the inner wall of member 12.

Figure 2:
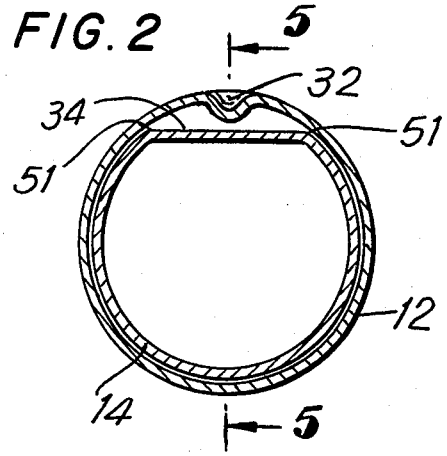
FIG. 2 is a horizontal cross-sectional view taken along the plane of line 2—2 in FIG. 1.

As may be readily observed in FIG. 2, member 14 can slide within member 12 in longitudinal fashion, but is prevented from rotating with respect to member 12 by the engagement of portions 51 and 52 which would engage the protuberance 32 and prevent further rotation therebetween. It should be understood that due to engineering tolerances and relative dimensions, that little or minor rotation between the respective members may occur. However, as soon as there is rotation beyond a minor amount, in the vicinity of from 10° to 40°, depending on tolerances, rotation would be prevented.

With reference to FIG. 3, it should be understood that rotation of inner member 14 in either direction would cause portions of the oval member 14 in juxtaposition to the point of minimum radius (at the end of the minor transverse axis) to engage the protuberance 34 and thereby prevent rotation.

As long as rotation is not attempted the members 12 and 14 may readily slide without engagement of protuberance 32 with portion 34, and when the desired longitudinal positioning of members 12 and 14 is obtained, means 18 may be utilized to secure the members in such position. The protuberance, which is located below the level of the securing means 16 would not interfere with the operation of means 18, and the portion 34 of reduced radial thickness would not affect the workings of the retaining means 18 as long as member 14 has at least one diametrical portion which runs the length of the member which is just slightly less than the inner dimension of tube 12.

As seen in FIG. 3, the split ring 28 would engage the points corresponding to the major axis of the oval portion in order to slidably secure member 14 and member 12. With reference to FIG. 4, where there is shown a substantially cylindrical bar having only a small portion 34 cut away therefrom, the split ring would engage substantially the entire circumference of member 14.

A latitude of modification, substitution and change is intended in the foregoing disclosure, and in some instances some features of the present invention may be employed without a corresponding use of other features and still remain within the scope, spirit and intent of the present invention.

I claim:

1. A nonrotatable telescoping supporting structure comprising:

an outer elongated tubular member of substantially cylindrical shape, an inner elongated member having at least one elongated portion of reduced radial size with respect to the longitudinal central axis of said inner member, said portion extending substantially the entire length of said inner member, and a stationary protuberance of fixed size and shape located on the inner surface of said outer member extending inwardly therefrom a distance such that said protuberance does not engage said portion of reduced radial size when such is opposite said protuberance, whereby said inner member is slidably disposed within said outer member when said radially reduced portion is opposite said protuberance and relative longitudinal movement of said members is possible but relative rotation is prevented by engagement of said protuberance with portions of said inner member located on either side of said reduced radial portion, said protuberance being a dimple formed in said outer member.

2. A supporting structure as in claim 1, wherein said inner member is oval in cross-sectional shape.

3. A supporting structure as in claim 1, wherein said inner member is substantially cylindrical in cross-section and said reduced radial portion is a flat longitudinal surface.

4. A supporting structure as in claims 2 or 3, wherein said inner portion is a hollow tube.

* * * * *